United States Patent [19]

Heller et al.

[11] 4,205,410

[45] Jun. 3, 1980

[54] WARE FINISH WIPER

[75] Inventors: Arthur D. Heller; Donald F. Hardy, both of Horseheads, N.Y.

[73] Assignee: Dart Industries, Inc., Los Angleles, Calif.

[21] Appl. No.: 934,778

[22] Filed: Aug. 18, 1978

[51] Int. Cl.[2] ..... B67C 1/00

[52] U.S. Cl. ..... 15/101

[58] Field of Search ..... 15/56, 59–72, 15/101

[56] References Cited

U.S. PATENT DOCUMENTS

| | | | |
|---|---|---|---|
| 956,056 | 4/1910 | Eick | 15/59 |
| 1,877,682 | 9/1932 | Miller | 15/60 |
| 2,044,041 | 6/1936 | Wynne | 15/59 |
| 2,111,797 | 3/1938 | Meyer | 15/60 |
| 2,340,215 | 1/1944 | Fowler | 15/59 |

*Primary Examiner*—Edward L. Roberts

*Attorney, Agent, or Firm*—Leigh B. Taylor

[57] ABSTRACT

A bottle finish wiping mechanism adapted to automatically position a plurality of bottles and subsequently wipe the finish areas of such bottles. The mechanism includes a plurality of wiper elements which are simultaneously movable into and out of contact with the bottles, and which, upon engagement therewith move cleaning pad surfaces against the finish areas of the bottle. When the cleaning pad surfaces are in engagement with the bottle the wiper elements rotate to effect cleaning.

12 Claims, 15 Drawing Figures

WARE FINISH WIPER

It is well known in the glass container fabrication business that various undesirable contaminants may be deposited upon ware finish areas during the ware manufacturing process. Accordingly, prior to the packing of such ware it is desirable to clean these areas for the purpose of removing such contaminants. Although various techniques such as manual wiping or washing have been available these are tedious and expensive in that they may require several intermediate packing and unpacking steps after initial inspection and before shipping.

This invention, therefore, is directed to an automated assembly that is designed to clean both the inside and outside of a plurality of bottleware finishes in those instances where mold lubricant and/or graphite residue deposits may be objectionable. The various attendant advantages arising from the use of such assembly include the fact that it can be easily included in the manufacturing production line thus eliminating the need for special cleaning steps. Furthermore, other than for the replacement of cleaning pad surfaces the apparatus is fully automated so that minimum operator attention thereto is required. Also to effect the rapid replacement of wiper elements the various head members are quickly removable and replaceable.

Additional objectives and advantages will become more apparent upon continuing reference to the specification, claims and drawings wherein:

Figure 1:
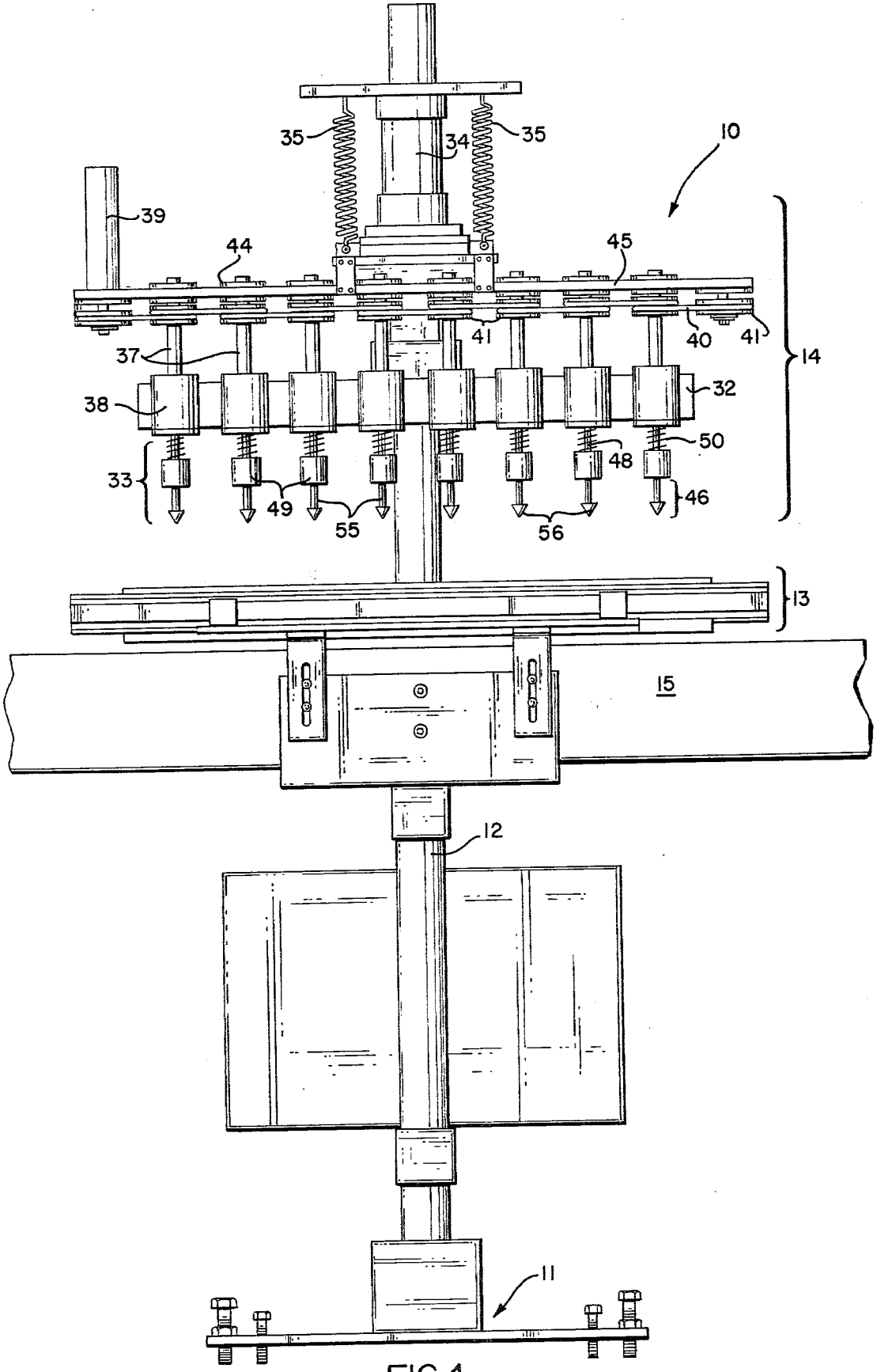
FIG. 1 is a front elevational view of the ware finish wiper assembly.

As can best be seen in FIG. 1 the ware finish wiper assembly 10 includes a pedestal base 11 and post 12 upon which are mounted a ware positioning mechanism 13 and a head assembly 14. The ware positioning mechanism 13 is adapted for placement on post 12 so as to be in juxtaposition with ware conveyor 15. Likewise, head assembly 14 is movable along post 12 so as to be at an appropriate distance from ware on conveyor 15.

Figure 2:
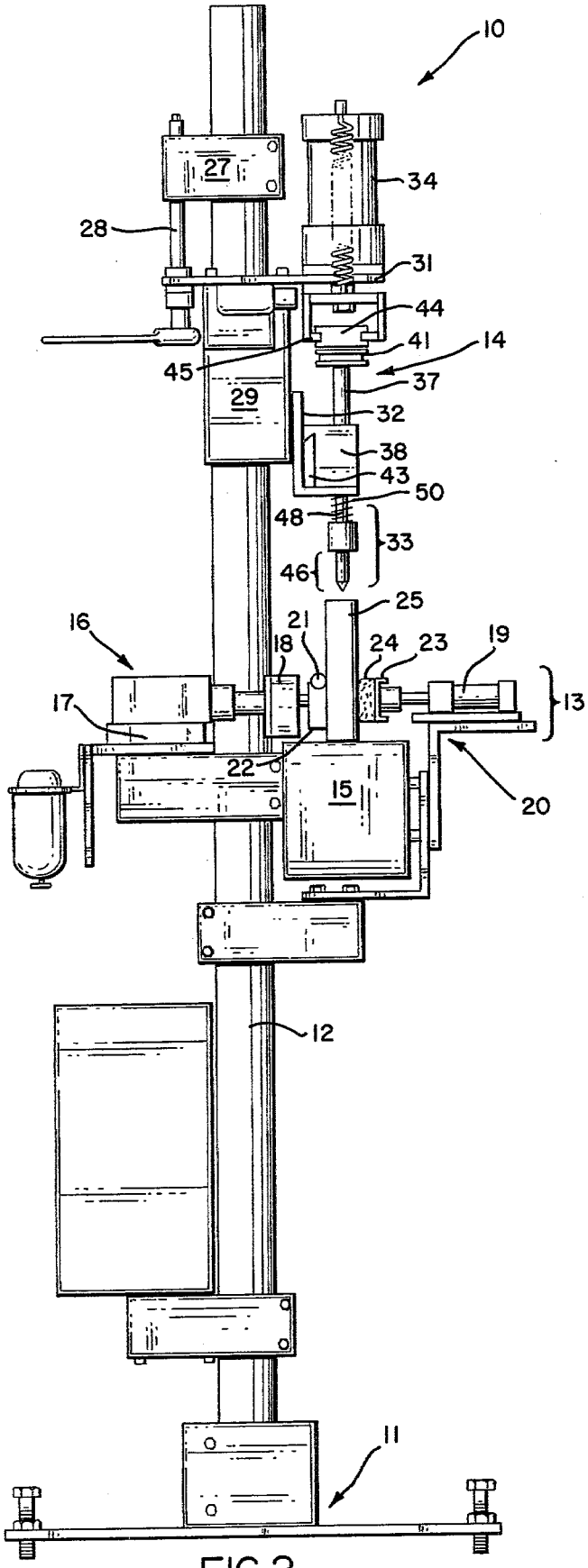
FIG. 2 is a side elevational view of the ware finish wiper assembly.

Ware positioning mechanism 13 includes both an upstream and downstream ware stop device 16 of which only the upstream device is shown (FIG. 2). Such device incorporates a mount 17 which in turn supports the stop member 18 and its actuator (piston/-cylinder arrangement) 19. These devices 16 are spaced one from another along the conveyor 15 so as to at least accommodate a predetermined number of bottles within the designated space therebetween.

Also included as a part of mechanism 13 is a clamping arrangement 20 that includes vertically separated reference guide rails 21 and 22 positioned above and along one edge of conveyor 15. The clamping rail 23 preferably incorporates a resilient surface segment 24 that can firmly yet safely grasp ware 25 between it and reference guide rails 21 and 22.

Figure 3:
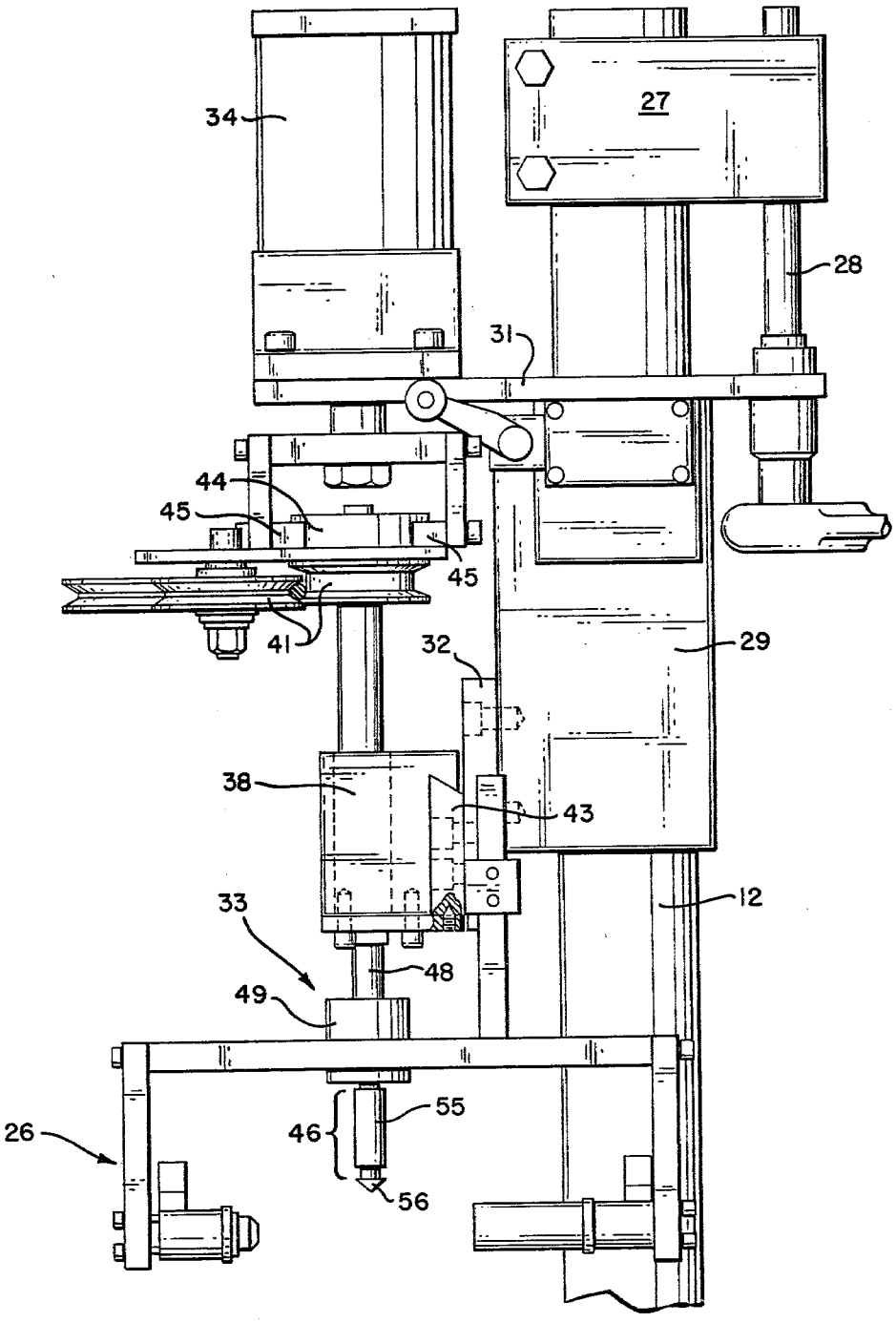
FIG. 3 is a partial side elevational view of the head assembly illustrating its mounting arrangement.
Figure 4:
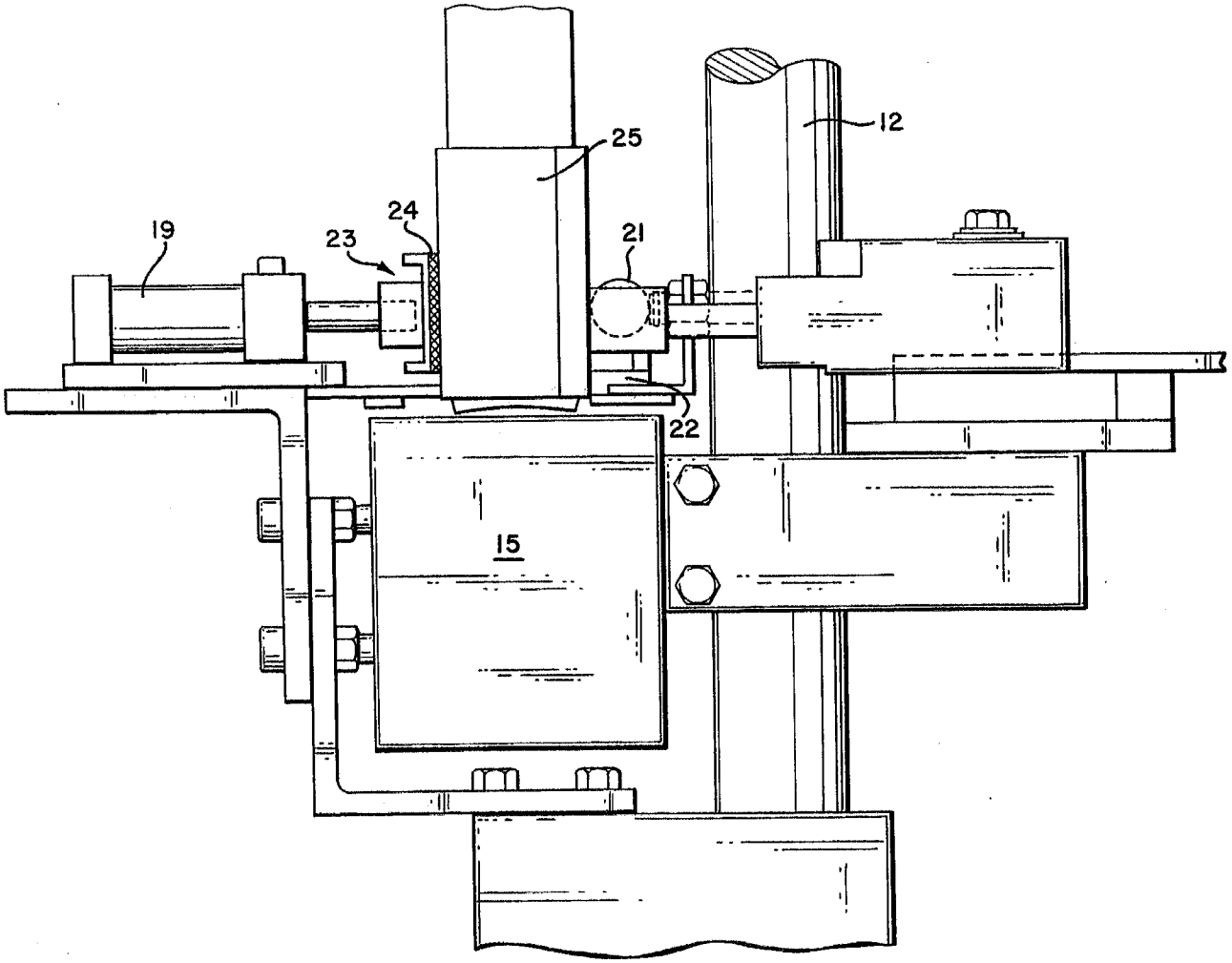
FIG. 4 is a partial front elevational view of the clamp arrangement portion of the ware finish wiper assembly.
Figure 5:
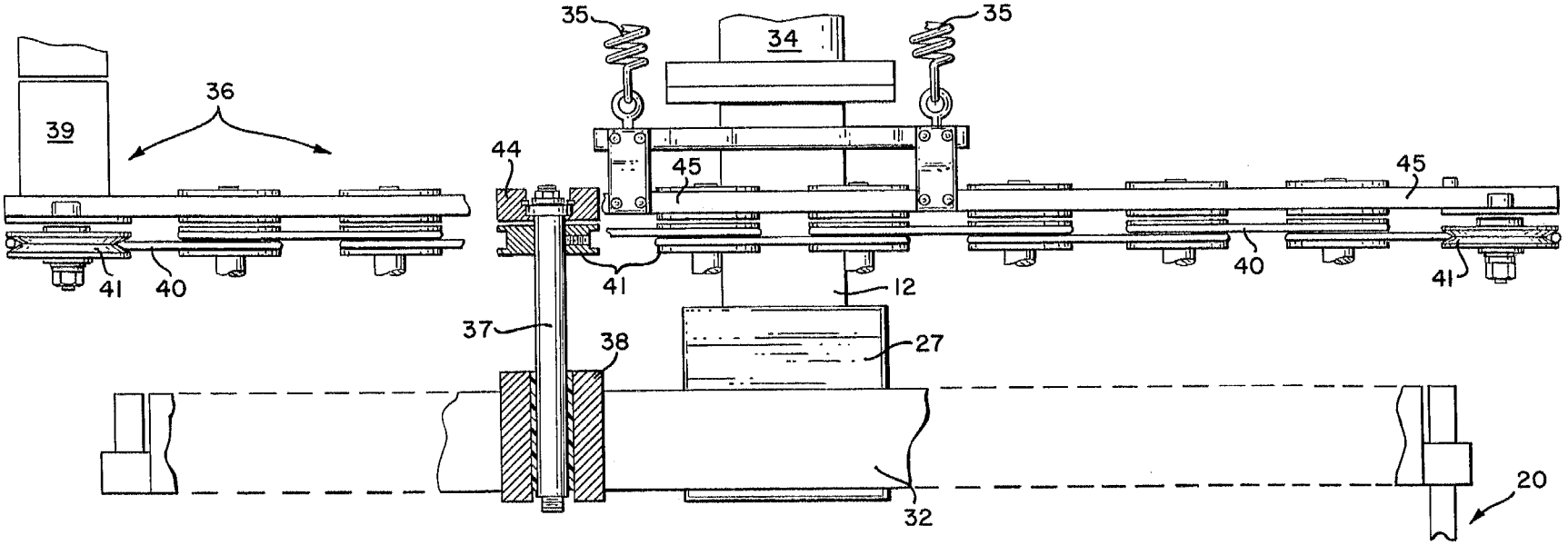
FIG. 5 is a partial front elevational view of the head assembly illustrating the mounting and driving means therefor.
Figure 6:
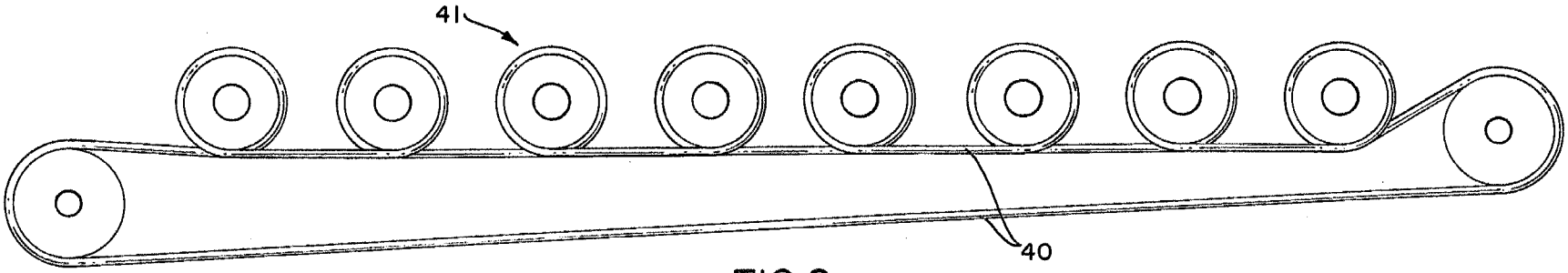
FIG. 6 is a top view of the driving belt arrangement for the preferred embodiment of the ware finish wiper assembly.

Ware stop devices 16 in conjunction with clamping arrangement 20 and counter photocell sensor 26 (FIGS. 1 and 3) assure that a predetermined number of bottles 25 will be properly positioned and retained along conveyor 15 and beneath head assembly 14 for such assembly to effectively and efficiently clean the finish areas thereof.

Head assembly 14 is, as above set forth, movably mounted on post 12 by means of a fixed clamp 27 which supports a threaded adjustment screw 28 and interconnected hub member 29. Fixed clamp 27 may be initially positioned along and rigidly affixed to post 12 thereby roughly positioning the overall head assembly 14 with respect to ware 25 on conveyor 15. Thereafter, by means of adjustment screw 28 the head assembly may be finely adjusted for the exact positioned relationship that is required for operation.

As is further apparent from FIGS. 1 and 2 hub member 29 supports horizontal plate 30 and vertical plate 31 for movement therewith. These two plates 30 and 31 form the support for each of the wiper units 32, the rotary driving assembly 33 for same and the reciprocable motor means 34 that moves the units 32 into and out of operative position.

As is further apparent from FIG. 2 such motor means 34 is assisted in the retraction of the wiper units by helper springs 35.

The mentioned supporting plates 30, 31 for wiper units 33 also mount the rotary drive means 36, spindle shafts 37 and adjustable spindle bearing mounts 38. The drive means 36 includes an air motor 39 and a circuitous belt drive 40 that traverses the pulley system 41.

Figure 8:
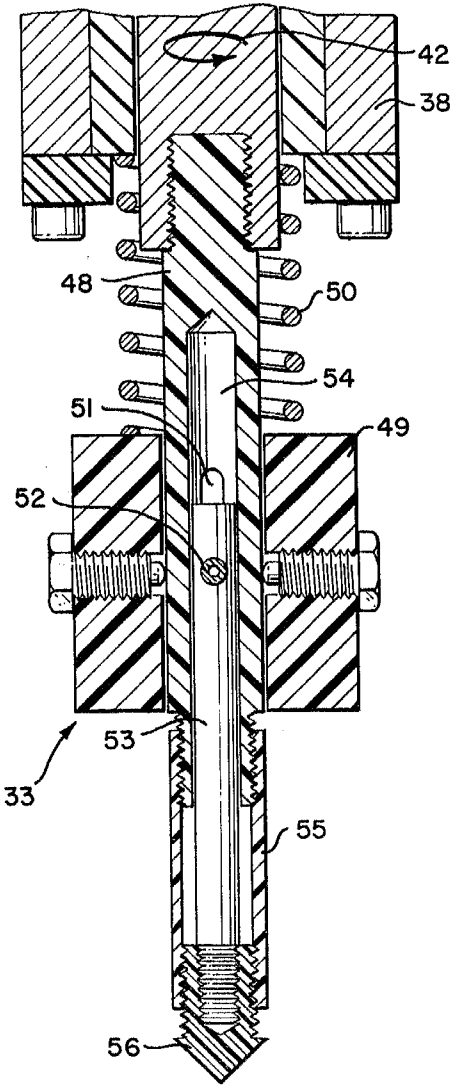
FIG. 8 is a cross sectional view of the internal member of a ware finish wiper assembly taken along line 8—8 of FIG. 7.
Figure 7:
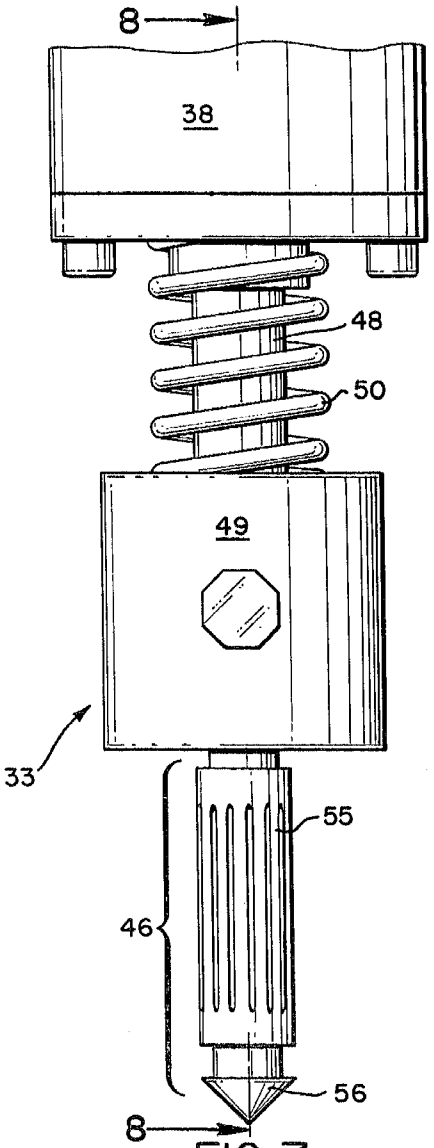
FIG. 7 is a partial front elevational view of the internal member of the ware finish wiper assembly.
Figure 10:
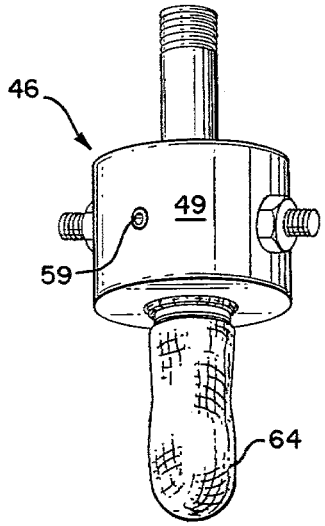
FIG. 10 is a front elevational view of the interior member of the finish wiper unit with wiping gauze affixed thereto.
Figure 11:
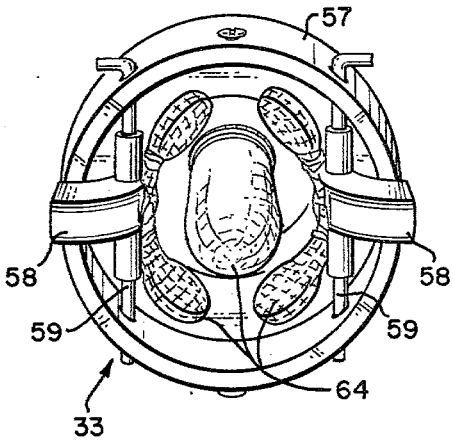
FIG. 11 is a bottom view of the interior and exterior members of the finish wiper unit with wiping gauze affixed thereto.
Figure 12:
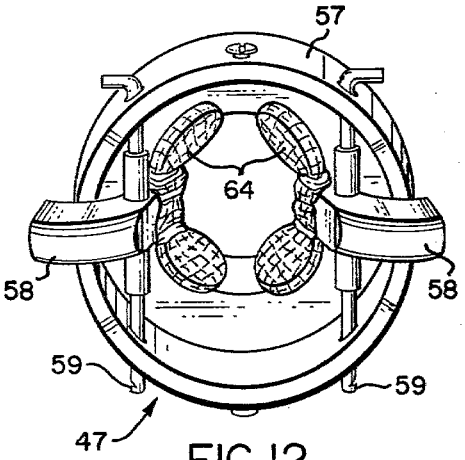
FIG. 12 is a bottom view of the exterior member of the finish wiper unit with wiping gauze affixed thereto.
Figure 13:
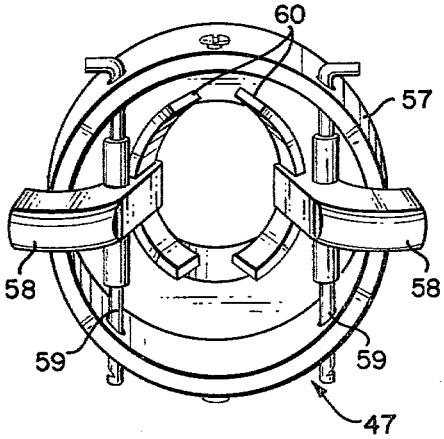
FIG. 13 is a bottom view of the exterior member of the finish wiper unit with the wiping gauze removed therefrom.
Figure 14:
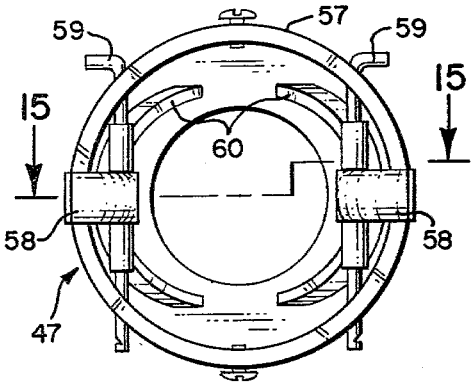
FIG. 14 is a bottom view of the exterior member of the finish wiper unit with the wiping gauze and resilient pads removed therefrom; and, FIG. 15 is a cross-sectional view of the exterior member of the finish wiper unit taken along line 15—15 of FIG. 14.
Figure 15:
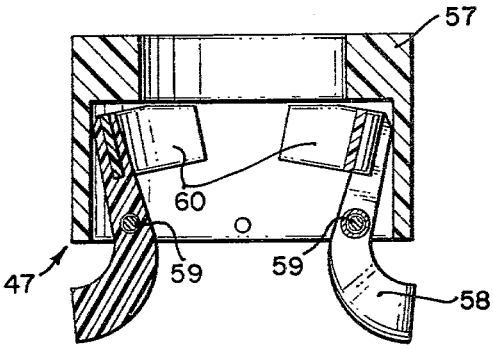

Accordingly, when air motor 39 is activated spindle shafts 37 are simultaneously rotated as shown by the arrow 42 in FIG. 8. As mentioned, the bearing mounts 38 are movable horizontally along vertical plate 32 on the semi-dovetail member 43. In like fashion the upper support bearings 44 for spindle shafts 37 move along the guide rails 45. Thus each wiper unit 33 may be accurately positioned above the ware it is to engage on conveyor 15 during the wiping operation.

As indicated, each wiper unit 33 includes an internal wiping element 46 and an external wiping element 47 each being mounted to the spindle shaft 37 by means of cored spindle 48 and collar 49.

Both the cored spindle 48 and collar 49 are rotatable with the spindle shaft 37 but in addition collar 49 is reciprocable along the cored spindle 48 and is biased therealong by means of spring 50. This reciprocable movement is controlled by opposed slot openings 51 in cored spindle 48, which slots accommodate the movement of pin 52.

The pin 52 is pressed through the collar 49 and shaft 53 which is adapted to reciprocate in the core 54 of cored spindle 48. Cored spindle 48 (FIG. 8) is threaded at both ends, (1) for easy attachment to spindle shaft 37 at one end and (2) to accommodate the slit plastic expander 55 at the other end. Likewise, one end of shaft 53 is threaded to accept the other end of expander 55 by means of an intermediate threaded nippler 56.

Figure 9:
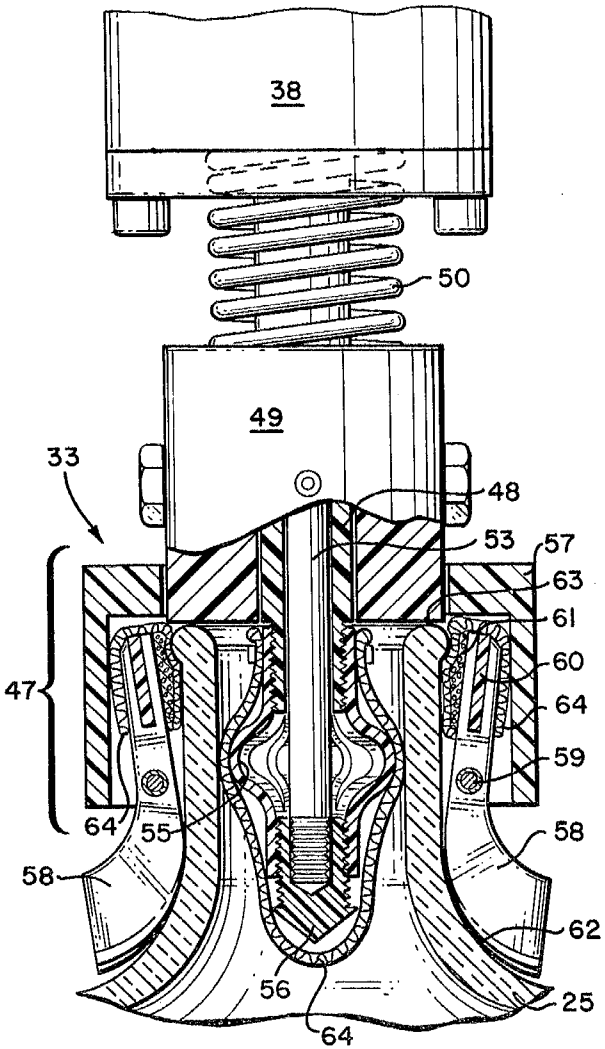
FIG. 9 is a partial cross sectional view of both the external and internal members of a ware finish wiper assembly shown in wiping position over a bottle finish.

The external wiping element 47 (FIGS. 11–15) is optionally positionable on collar 49 (FIG. 9) and is of the following construction. Shell 57 is positioned on collar 49 by means of set screws (not shown) and it mounts pivotal actuating arms 58 by means of pins 59. The arms 58 further support wiping rings 60 which in turn are padded with resilient material 61.

In operation (FIG. 9) each wiping unit as it is driven downwardly by reciprocable motor means 34 causes the internal wiping element 46 to enter the finish of ware 25 and the external element 47 to surround the outside of that ware finish. Upon the continued downward movement collar 49 bottoms on the top 63 of ware 25, thus driving cored spindle 48 further downward with respect to collar 49 and shaft 53. This relative movement shortens the distance between the lower threaded end of cored spindle 48 and nippler 56 thereby expanding expander 55. Likewise because of the mentioned downard movement actuating arms 58 contact the shoulder 62 of ware 25, thus pivoting wiper rings 60 into close proximity with the ware finish exterior.

Both the expander 55 and the wiping rings 60 are covered with finger bandages or similar soft material 64 which does the cleaning. After the wiper units are in cleaning position (FIG. 9) the air motor 39 is activated to rotate the units and simultaneously the head is withdrawn by reciprocable motor means 34 and helper springs 35. This gives a multidirectional wiping action that throughly cleans the ware finish.

As the unit 33 reaches its upper position spring 50 acting upon collar 49 drive it to its lower-most position thus resetting internal wiping element 46.

To prevent ware from being turned or lifted from the conveyor as the wiping fingers are operating, a cylinder-driven, plastic-foam surfaced guide rail clamps the ware between it and a reference back rail. The reference back rail consists of two independently adjustable nylon bars, one above the other. These bars can be adjusted to conform to tapered sides of ware when necessary. The reference rails center the ware transversely beneath the spindles containing the wipers.

The drive system was designed to operate all spindles from a single drive motor. Drive pulleys for the spindles in the form of spools, allow a full turn (360°) of the drive belt around each spool. This allows each spindle to be adjusted independently toward or away from the drive with a constant belt length. Also, all spindles are rotated in the same direction whereby wiper mounting threads tend to tighten rather than loosen. The drive system is actuated at the proper time by an electronic control.

The control system is essentially a simple electronic sequencing timer and a photocell actuated electronic counter which gives the following machine sequence.

1. Down stream ware-stop is closed, upstream ware-stop is open, conveyor brings in ware past the counter photocell sensor.
2. At end of preset count upstream ware-stop closes, ware is grouped in machine beneath spindles.
3. Spindle head is driven downward by head cylinder.
4. Spindle head actuates microswitch which engages clamping guiderail.
5. Spindle head continues to maximum downward position engaging wiper collars with ware finishes which expand the wiping fingers.
6. Spindle head cylinder powered upward and at same time spindle drive motor is turned on.
7. Spindle reaches upward position, spindle motor is off, wiping fingers are reset, clamping rail is disengaged, downstream ware-stop retracts, ware is carried out of machine.
8. Counter is reset, upstream ware-stop opens, downstream ware-stop closes.

All mechanical actuations are pneumatically powered including the drive motor.

We claim:

1. A ware finish wiper adapted to clean the finish area of bottle ware and including, a movable head assembly having affixed thereto at least one rotatable spindle, said spindle incorporates a wiper unit adjacent the distal end thereof, and said wiper unit further including an interconnected shaft and collar that are axially positioned with and upon said spindle for reciprocation with respect thereto and an expander affixed to said distal end and to one end of said shaft.

2. A ware finish wiper according to claim 1 wherein said expander is resilient plastic tube having a plurality of longitudinal slits positioned intermediate the ends thereof.

3. A ware finish wiper according to claim 1 wherein resilient means are positioned between said head assembly and said collar.

4. A ware finish wiper according to claim 3 wherein said spindle includes a bore within which said shaft is positioned and at least one longitudinal slot extending between the bore and the exterior surface of the spindle.

5. A ware finish wiper according to claim 3 wherein a pin extends through said slot and between said collar and shaft.

6. A ware finish wiper according to claim 5 wherein said resilient means biases said collar, shaft and expander to an extended position determined by the respective locations of said slot and pin.

7. A ware finish wiper according to claim 1 wherein said spindle includes movable elements adjacent the distal ends thereof for disposition over and around the ware finish exterior.

8. A ware finish wiper according to claim 1 wherein said spindle includes means adjacent the distal end thereof for disposition over and around the ware finish exterior.

9. A ware finish wiper according to claim 8 wherein said means are attached to a shell member that is affixed to said spindle.

10. A ware finish wiper according to claim 9 wherein said means are pivotably attached to said shell member by pins, which means are adapted to engage said bottle ware to effect the pivotal movement of said elements.

11. A ware finish wiper according to claim 1 wherein additional means for disposition over and around the ware finish exterior is attached to a shell member that is affixed to said collar.

12. A ware finish wiper according to claim 11 wherein said means are arms that are pivotably attached to said shell member by pins, which arms are adapted to engage said bottle ware to effect the pivotal movement thereof.

* * * * *